United States Patent [19]

Prager et al.

[11] Patent Number: 4,841,127

[45] Date of Patent: Jun. 20, 1989

[54] DUAL TEMPERATURE HAIR CURLER UTILIZING A PAIR OF PTC HEATERS

[75] Inventors: Lee A. Prager, Raymond; Douglas C. Carbone, Standish, both of Me.

[73] Assignee: GTE Products Corporation, Stamford, Conn.

[21] Appl. No.: 34,516

[22] Filed: Apr. 6, 1987

[51] Int. Cl.[4] ..... H05B 1/02; H05B 3/24; H01C 7/02; A45D 1/04

[52] U.S. Cl. ..... 219/225; 132/232; 219/230; 219/241; 219/505; 219/534; 219/544; 338/22 R

[58] Field of Search ..... 219/222–226, 219/230, 236–241, 505, 504, 534, 544, 530, 548; 132/37 R, 37 A, 9, 11 R; 338/22 R, 22 SD, 23

[56] References Cited

U.S. PATENT DOCUMENTS

| | | | |
|---|---|---|---|
| 2,507,736 | 5/1950 | Ritchie et al. | 219/240 |
| 3,400,250 | 9/1968 | Buiting et al. | 219/505 X |
| 3,953,711 | 4/1976 | Eck et al. | 338/22 R |
| 4,147,927 | 4/1979 | Pirotte | 219/505 X |
| 4,151,401 | 4/1979 | Van Bokestal et al. | 219/505 X |
| 4,267,430 | 5/1981 | Downey | 219/222 |
| 4,365,140 | 12/1982 | Bast et al. | 219/225 |
| 4,493,972 | 1/1985 | Steimel et al. | 338/22 R |
| 4,673,798 | 6/1987 | Comtri et al. | 219/225 |

FOREIGN PATENT DOCUMENTS

| | | | |
|---|---|---|---|
| 87619 | 9/1983 | European Pat. Off. | 219/505 |
| 4519107 | 5/1965 | Japan | 219/505 |

*Primary Examiner*—Anthony Bartis
*Attorney, Agent, or Firm*—James Theodosopoulos

[57] ABSTRACT

A dual temperature hair curler has a hollow heat transmitting metallic barrel enclosing a pair of PTC heaters connected in series to each other and electrically insulated from the barrel by an oxide-filled silicone rubber material. The PTC heaters have different anomaly temperatures and a switch arrangement is provided for (1) energizing the higher anomaly temperature heater a series with the lower anomaly temperature heater to produce a low temperature limited by the anomaly temperature of the lower temperature heater and (2) effectively energizing only the higher anomaly temperature heater to produce a high temperature limited by the anomaly temperature of the higher temperature of the higher temperature heater by bypassing the lower anomaly temperature heater.

7 Claims, 3 Drawing Sheets

DUAL TEMPERATURE HAIR CURLER UTILIZING A PAIR OF PTC HEATERS

FIELD OF THE INVENTION

The present invention relates to dual temperature heaters or thermistors using two PTC heaters or thermistors of different anomaly temperatures and especially to the use of such PTC heaters in a hair curling iron.

BACKGROUND OF THE INVENTION

The use of more than one PTC heater to heat an object is well known to the art and hair curlers have also been developed which utilize resistance heating devices to radiate their heat onto an iron. Generally, hair curlers have utilized multiple nichrome wire heating elements and switchable thermostats to allow for different temperatures of operation. With single temperature units of the prior art, the wattage of the Nichrome heating element is limited in order to provide a steady temperature state in the barrel of the curler. Because the wattage is limited, during the time that the curling iron heats up, the current is limited also and the heat-up time can be rather prolonged. When only one Nichrome wire is used, a current-limiting device is usually connected to it. The current-limiting device adds cost to the hair curler, and is subject to premature failure. When the wattage is increased to increase the rate of heating, a thermostat is needed to limit the steady state temperature. Since the thermostat is a mechanical device, it's life and reliability can be limited and it's use can add cost to the hair curler. When multiple Nicrome wire heating elements are used for dual range temperature settings, the costs are multiplied and the reliability is reduced.

We have found that many of the problems associated with the use of conventional Nichrome wire heating elements can be eliminated by the use of PTC heaters as the heat source. PTC heaters have been in use for many years. Such heaters offer several operating advantages over conventional resistance heating elements in the heating of devices that will impart their heat to other objects. The PTC heater is generally made of a doped barium titinate ceramic which has a sharp positive temperature coefficient of resistance. The PTC heaters are designed such that below a critical temperature, the resistance of the ceramic remains at a low value and is essentially constant or even decrease with increasing temperature. When a predetermined temperature is reached, a crystalline phase change takes plae in the ceramic and this change in crystal structure is accompanied by a sharp increase in the resistance at the crystalline grain boundaries. The result of this crystalline change is an increase in the heater resistance of several orders of magnitude over a very small temperature range. A barium titinate heater with a room temperature resistance of 3 ohms will increase to 1,000 ohms or more during the crystalline phase change. The temperature at which the crystalline phase change takes place can be adjusted in the PTC heater manufacturing process through the use of appropriate chemical dopents and can be varied between −50° C. and 300° C. When energized with a suitable current by applying voltage to the opposite sides of the PTC heater, the ceramic rapidly heats up to a predetermined operating temperature and then "locks in" at this temperature. This rapid heating is due to the initial low resistance of the PTC heater which results in an internal high power of the heater.

The "lock in" is due to the abrupt increase in resistance which causes generated heat to be reduced until it equals dissipated power. At this point, thermal equilibrium is achieved and the heater regulates itself with regard to its temperature characteristics.

The use of two PTC heaters in a heater of a hair curler iron has several advantages. According to the present invention, two PTC heaters with different anomaly temperatures and with welded leads are disposed in the barrel of a hollow aluminum extrusion. The portions of the barrel that are not occupied by the PTC heaters are filled with silicon rubber that is filled with 50 to 80 weight percent magnesium oxide or similar heat transmitting, electrically non-conductive material. The barrel (which may be coated with Teflon, a registered trademark of the DuPont Corporation, to improve its chemical resistance) acts directly as a hair curler and provides for an extremely effective heat transfer from the PTC heaters to the surface of the barrel.

The hair curler heats up extremely rapidly due to the resistance temperature characteristics of the PTC heaters. When the assembly is cold, the PTC heaters are in their low resistance state and cause a high wattage to be developed. This high level of wattage quickly heats the barrel until the resistance of the of the lower anomaly temperature PTC heater begins to increase, thereby decreasing the wattage developed. As the temperature increases and the wattage decreases, an equilibrium condition is reached and the barrel is regulated at the predetermined equilibrium temperature. The cold to hot wattage ratio can be between about 5 to 15 times thereby explaining the significant heat up rate improvement that a PTC heater has over Nichrome wire which is controlled with a wattage limiting device. Lower mass or heat capacity fillers such as magnesium oxide, and the minimal use of the silicon rubber compound reduces the thermal mass of the system and further improves the heating rate.

When two PTC heaters are used in the hair curler, in addition to the extremely fast rate of heating, two different operating temperatures can be readily achieved. When the two PTC heaters are electrically connected in series with a switch set in the low position (FIG. 2*a*), current must pass through both PTCs and will be limited when the PTC heater with the lower resistance temperature characteristic reaches its anomaly temperature. This limit is not reached until after the entire system begins to heat, and the low temperature-high wattage condition still exists so as not to compromise the rate of heating of the PTC heaters. When the switch is turned to the high position, the low temperature PTC heater no longer limits current to the high temperature PTC heater and the system comes to equilibrium at the temperature associated with the PTC having a higher anomaly temperature.

DESCRIPTION OF THE PREFERRED EMBODIMENT

Figure 1A:
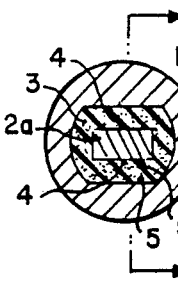
FIG. 1A is a cross-sectional view of the barrel of a heater of a hair curler showing the disposition of two PTC heaters in the device and FIG. 1A is a cross sectional view of the barrel of a heater of a hair curler showing one of the PTC heaters in the center of the barrel. The view is taken along the line 1A—1A in FIG. 1B.
Figure 1B:
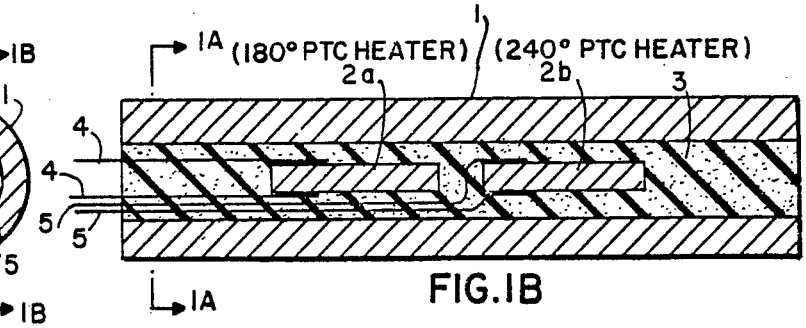
FIG. 1B is a cross sectional view of the device shown in FIG. 1A taken along the line 1B—1B.

Referring now to FIG. 1A and 1B, the barrel 1 of the dual temperature heat curler is formed of extruded aluminum and generally has walls between about 0.020 and 0.040 inches thick. The barrel 1 has two PTC heaters 2*a* and 2*b* disposed in the center thereof and surrounded with a magnesium oxide filled, silicone rubber 3. Lead-in wires 4 extend inside of barrel to PTC heater 2*a* and lead-in wires 5 extend to PTC heater 2*b*. Each of the sets of lead-in wires 4 and 5 are welded to opposite sides of PTC heaters 2*a* and 2*b* whereby they contact film electrodes (not shown) to provide the resistance heating such as described herein. PTC heater 2*a* has an anomaly temperature of approximately 180° C. and PTC heater 2*b* has an anomaly temperature of approximate of 240° C. The anomaly temperature of the low temperature PTC heater 2*a* is such that it will enable the user of the hair curler to provide the appropriate thermal setting necessary to curl hair at a low temperature and the PTC heater 2*b* provides an anomaly temperature which is adequate for high temperature hair curling. Each of the lead-in wires 4 and 5 connect to an electric circuit whereby the PTC heaters can be connected in series and heat the barrel 1 to the desired temperature. The ends of the barrel 1 are closed although not shown in this Figure, for the safety and convenience of the user.

Figure 2A:
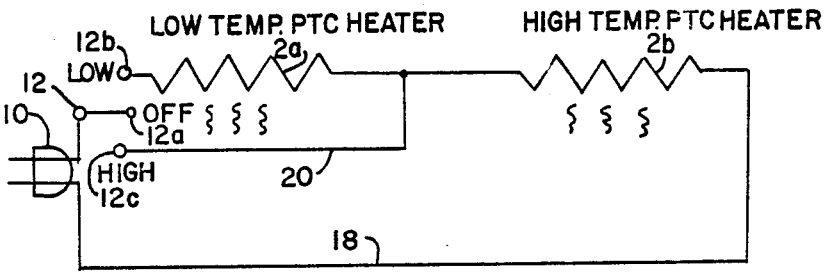
FIG. 2A is a circuit diagram showing one embodiment of a circuit for wiring of the PTC heater and FIG. 2B shows another embodiment of the circuit.

As shown in FIG. 2A, a plug 10 adapted to be inserted in a 120 volt AC outlet (although PTC heaters work equally well on 240 volt systems) is shown. One side of the power supply is directed to a three-way switch 12 which includes an "off" setting 12*a*, a "low" setting 12*b* and a "high" setting 12*c*. When the three-way switch 12 is in the off position 12*a*, the PTC heaters are not connected in the circuit. In the embodiment shown in FIG. 2A, upon switching the three-way switch 12 to the low setting 12*b*, the current passes through the low temperature PTC heater 2*a* and in series through the high temperature PTC heater 2*b*.

The opposite side of the power supply 10 is connected through lines 18 to the opposite side of the PTC heater 2*b*. In the embodiment shown in FIG. 2A, when the three-way switch 12 is moved to the high temperature position 12*c*, the low temperature PTC heater 2*a* is removed from the circuit and current passes through line 20 to the high temperature PTC heater 2*b*, whereby the low temperature PTC heater 2*a* will cool down. In another embodiment, as will be explained herein with reference to FIG. 2B, the circuitry can be arranged to enable the high temperature PTC heater to operate above at its predetermined temperature.

The two PTC heaters 2*a* and 2*b* can have anomaly temperatures at 180° and 240° C. respectively, and the voltage applied to the PTC heaters can vary between 120 and 240 volts, thereby allowing the PTC hair curler to be operated on different voltages throughout the world.

Figure 2B:
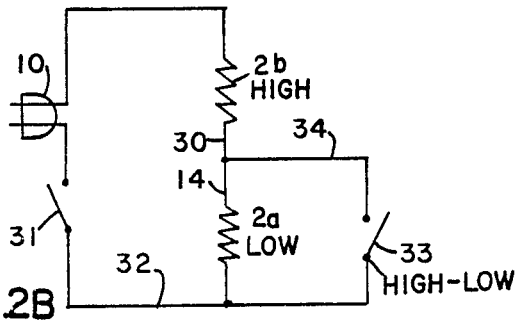

Referring now to FIG. 2B, the low temperature PTC 2*a* is connected in series with the high temperature PTC heater 2*b* through line 30. Current from a 120 volt AC source is provided through a plug 10. An on-off switch 31 is disposed on line 32 and, when closed, provides current to PTC heaters 2*a* and 2*b*. If switch 33 is open, low anomaly temperature PTC heater 2*a* limits the current to high temperature PTC heater 2*b*, thereby preventing it from reaching a temperature higher than the low temperature PTC heater 2*a*. When switch 33 is closed, current will pass on line 34 to high temperature PTC heater 2*b* allowing it to reach it's anomaly temperature. When switch 33 is closed, PTC heater 2*a* is bypassed so that only PTC heater 2*b* operates to generate heat.

Figure 3:
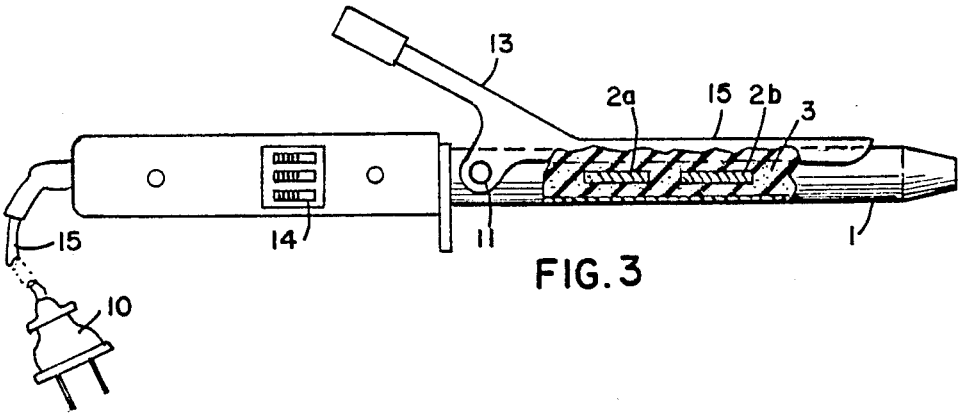
FIG. 3 is an elevational view, partially in cross-section, of a curling iron using the heater arrangement of the present invention.

Referring now to FIG. 3, a typical hair curler is shown. The hair curler includes a barrel 1 that may be coated with Teflon (not shown) to aid in its use. A mating press foot 15 is pivotably attached at axis 11 with a rivet or other suitable attachment devices and is urged against the barrel 1 by means by a spring (not shown). The press foot 15 may be rotated about the axis 11 by means of a thumb-operated lever 13 that extends from it. As shown in the cut away section, the PTC heaters 2*a* and 2*b* are disposed inside of the barrel and securely positioned therein by means of the magnesium oxide filled silicon rubber. A three-way switch 14 is disposed on the handle of the hair curler and enables the user to switch the device on and off and also to allow the selection of either high or low operating temperatures. While in this Figure, the PTC heaters 2*a* and 2*b* are shown spaced from each other, it is also possible to dispose them nearly side by side, save for a gap to provide electrical insulation, which will improve the temperature distribution across the barrel of the hair curler.

Figure 4:
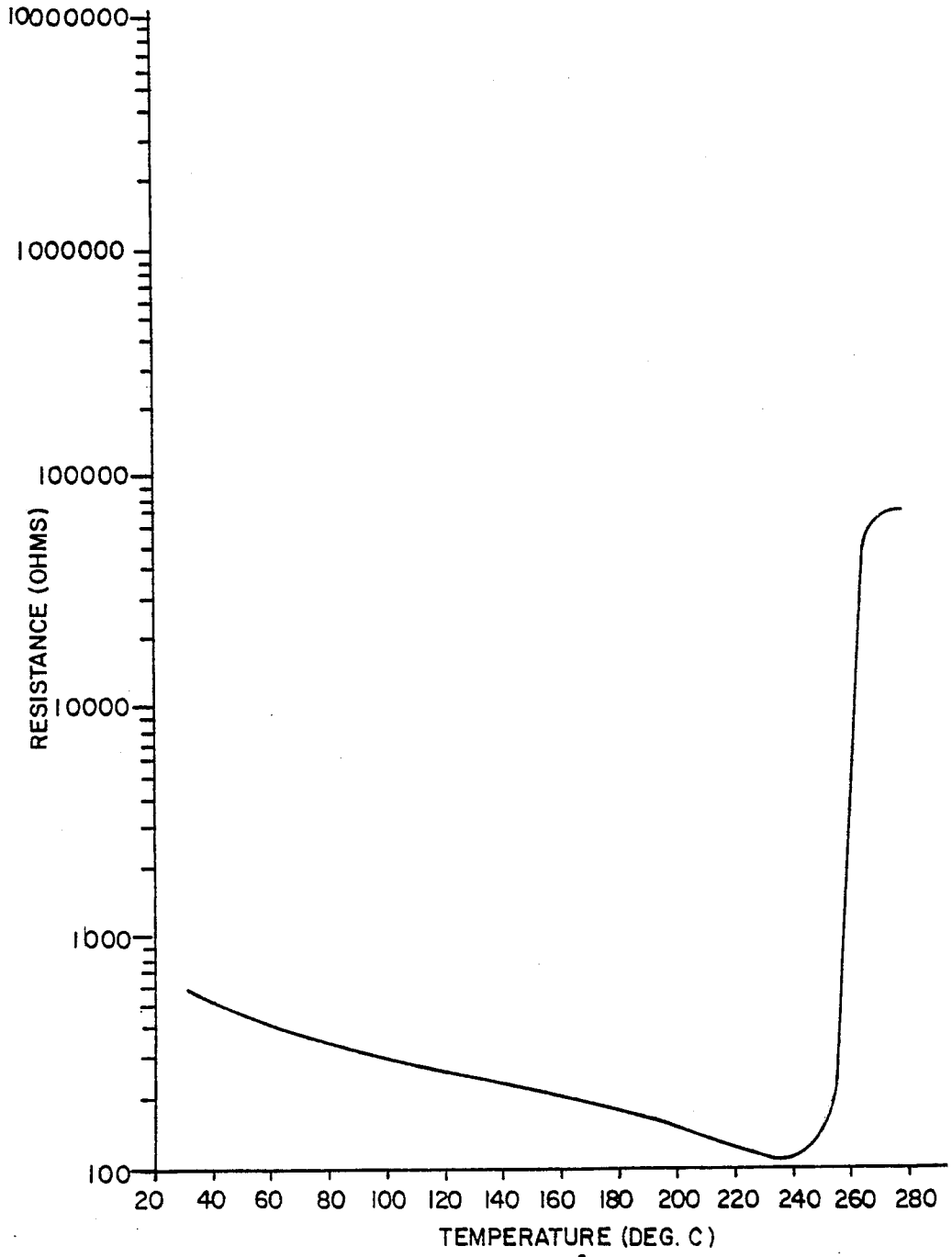
FIG. 4 is a curve illustrating the change in resistance of a PTC heater and depicting the sharply anomaly temperature of the device.

A curve measuring the resistance of a typical PTC heater in ohms is shown in FIG. 4. As can be seen, the resistance of the depicted PTC heater is approximately 600 ohms at 30° C. and the resistance decrease to approximately 100 ohms at 240° C. Between 240° and 260° C., the resistance increases dramatically to over 10,000 ohms and it approximates 70,000 ohms at 270° C. Above 270° C., the resistance plateaus at approximately 70,000 ohms.

Figure 5:
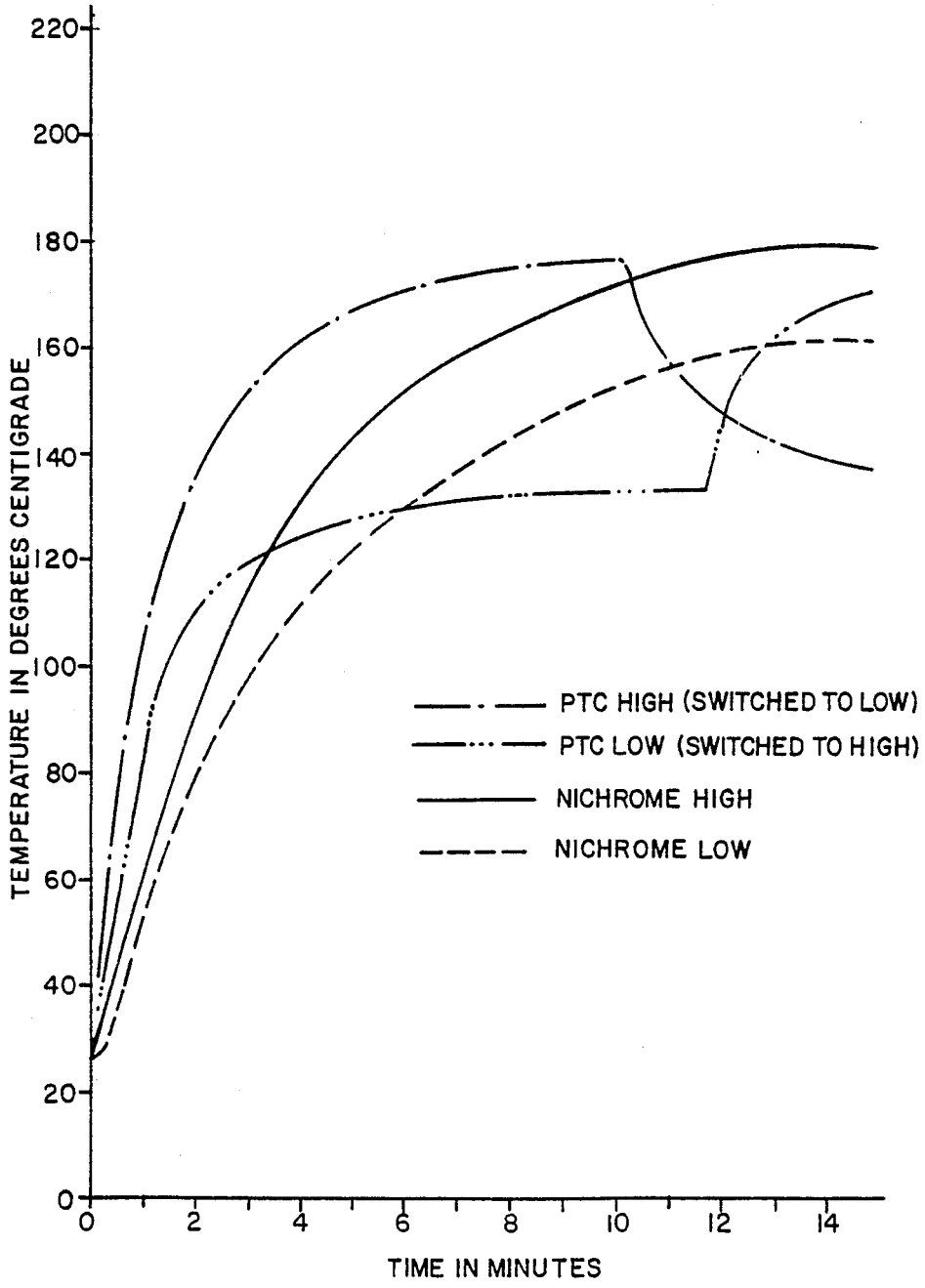
FIG. 5 is a set of curves illustrating the warp up and cool down times of PTC heaters and further illustrating a comparison of such PTC heaters to conventional nichrome wire resistance heaters.

Turning now to FIG. 5, the heating and cooling rates of two PTC heaters are compared to the heating rates of resistance heaters using Nichrome wires. As can be seen, a high temperature Nichrome wire fully heats up in approximately 13 minutes, at which point it stabilizes. The low temperature Nichrome wire heats up in approximately 13 minutes also. With the PTC heaters, a stabilized temperature of a low temperature PTC heater is achieved in approximately 5 minutes and a high temperature PTC heater reaches it in approximately 7 minutes. When the low temperature PTC heater is turned off and the high temperature PTC heater is switched on, a stable operating temperature is achieved in approximately 3 or 4 minutes. On the other hand, when the high temperature PTC heater is switched off and the low temperature device is turned on, a stable operating temperature is achieved in approximately 5 minutes. The rapid achievement of either low temperature or high temperature operating conditions enables the user to operate the hair curler quickly after it is plugged in and be assured that stable operating temperatures will be realized.

Moreover, since the PTC heaters will operate on most conventionally used operating voltages, hair curlers utilizing such PTC heaters can be sold throughout the world, irrespective of the voltages used in the various countries. In the device that has been described herein, the barrel that holds the PTC heaters is the curling iron itself, thereby eliminating thermal losses and inefficiency due to transfer of heat from a resistance heater to air and then to the barrel of a curling iron.

It is apparent that modifications and changes can be made within the spirit and scope of the present invention. But it is our intention, however, only to be limited by the scope of the appended claims.

As our invention, we claim:

1. A heater device adapted to attain predetermined temperatures in high and low settings, said heater device comprising:

an elongated hollow body of heat transmitting material;

at least two PTC heaters having different anomoly temperatures disposed in said body, one of said PTC heaters having a higher anomoly temperature than the balance of said PTC heaters and means to conduct current to opposite sides of each of said PTC heaters;

said current conducing means, including means electrically connecting said PTC heater in series with each other;

switch means including said PTC heaters connected to a power source through said current conducting means, said switch means cooperating with said current conducting means and said PTC heaters to produce a low temperature and a high temperature in said heater device by either (1) energizing the higher anomoly temperature heater in series with a lower anomoly temperature heater or (2) effectively energizing the higher anomoly temperature heater alone, said PTC heaters being arranged relative to each other and said current conducting means so that when a lower anomoly temperature PTC heater is energized, the higher anomoly temperature PTC heater in series therewith is simultaneously energized whereby the higher anomoly temperature PTC heater is limited in the temperature that it can attain by said lower anomoly temperature PTC heater.

2. The heater according to claim 1 wherein said body is an elongated cylinder having an internal bore, and heat transmitting, electrically insulating means is disposed in said bore, whereby heat from said PTC heaters can be transferred to said body and said body is electrically insulated therefrom.

3. The heater according to claim 1 wherein said switch means comprises a three-way switch having an off setting, a low temperature setting and a high temperature setting, and said low temperature setting of said three-way switch being arranged to simultaneously energize in series a PTC heater having a lower anomoly temperature and the PTC heater having the higher anomoly temperature, and said high temperature setting of said switch energizing only the PTC heater having the higher anomoly temperature.

4. The heater according to claim 1 wherein the anomoly temperature of the higher anomoly temperature PTC heater is at least 25% greater than that of the lower anomoly temperature PTC heater.

5. A hair curler comprising:

a hollow heat transmitting barrel;

at least two PTC heaters disposed in said barrel and electrically insulated therefrom;

said PTC heaters being connected in series to each other;

one of said PTC heaters having an anomoly temperature higher than the balance of said PTC heaters;

switch means for selecting a high temperature of low temperature setting and for connecting said PTC heaters to each other and to a power supply, said switch means being connected to the heaters and arranged to (1) energize the higher anomoly temperature heater in series with a lower anomoly temperature heater to produce a low temperature limited by the anomoly temperature of the lower anomoly temperature heater, and (2) effectively energize only the higher anomoly point heater to produce a high temperature limited by the anomoly temperature of the higher anomoly temperature heater.

6. The hair curler according to claim 5 wherein the lower anomoly temperature PTC heater is removed from the circuit by said switch means when said high anomoly temperature PTC heater is effectively energized alone.

7. The hair curler according to claim 5 wherein the current flows in series through said low anomoly temperature PTC heater to the high anomoly temperature PTC heater when the low anomoly temperature PTC heater is energized by said switch means whereby each of the PTC heaters is energized by current flowing therethrough when the low temperature PTC heater is turned on.

* * * * *